United States Patent [19]

Yamamura et al.

[11] Patent Number: 4,615,325

[45] Date of Patent: Oct. 7, 1986

[54] BALL THROWING DEVICE

[75] Inventors: Yukio Yamamura; Shinpei Otsuka; Takahiro Imai; Kenji Kakiyama, all of Osaka, Japan

[73] Assignee: Matsushita Electric Works, Ltd., Osaka, Japan

[21] Appl. No.: 727,531

[22] Filed: Apr. 26, 1985

[30] Foreign Application Priority Data

May 15, 1984 [JP] Japan ..... 59-98115

[51] Int. Cl.[4] ..... A63B 69/40

[52] U.S. Cl. ..... 124/7

[58] Field of Search ..... 124/7, 6

[56] References Cited

U.S. PATENT DOCUMENTS

| | | | |
|---|---|---|---|
| 754,745 | 3/1904 | Clark | 124/7 |
| 817,928 | 4/1906 | Medley | 124/7 |
| 1,053,029 | 2/1913 | Hansen et al. | 124/7 |
| 1,733,394 | 10/1929 | Bible et al. | 124/7 |
| 2,705,945 | 4/1955 | Cavalier | 124/6 |
| 2,792,822 | 5/1957 | Ponza | 124/7 |
| 4,209,003 | 1/1980 | Salisbury . | |

*Primary Examiner*—Paul E. Shapiro

*Attorney, Agent, or Firm*—Koda and Androlia

[57] ABSTRACT

A ball throwing device including a throwing arm having one end pivotally mounted and defining at the other end a ball receiving portion. The throwing arm is driven to swing within a limited angular range between a cocked position and a releasing position so as to throw a ball fed to the receiving portion when moved toward the releasing position. Cooperative with the throwing arm is an annular guide which extends approximately along the path of the ball receiving portion so as to deliver the ball fed at one end thereof to the ball receiving portion of the throwing arm at the cocked position. The guiding surface of the annular guide is configured to be increasingly displaced outwardly from the path of the ball receiving portion in the direction of throwing the ball. Accordingly, the ball can be held on the ball receiving portion in loose engagement therewith while being prevented from dropping out therefrom to thereby assure the projection of the ball with less spin.

2 Claims, 11 Drawing Figures

BALL THROWING DEVICE

BACKGROUND OF THE INVENTION

1. Field of the Invention

The present invention is directed to a ball throwing device for use in practicing tennis, baseball batting practice, and more particularly to a ball throwing device for throwing tennis balls, baseballs, and the like in a tossing or underhand manner.

2. Prior Art

There have been proposed a number of ball throwing devices in which a ball throwing arm is propelled such as by the biasing force of spring means to throw a ball in a given trajectory. For the purpose of tossing a flat ball or ball with less spin in a controlled manner for effective practicing and of keeping energy loss at a minimum, such device is required to have less frictional or loose-touch engagement between the ball and a ball receiving portion of the throwing arm.

However, the above attempt of reducing the friction will result in the failure of properly holding the ball of the arm, thus causing the ball to accidentally drop out from the arm before being thrown. To this end, the prior device for throwing the ball in a tossing or underhand manner has been devised to include a guide rail which extends in the path of the ball receiving portion of the throwing arm to be cooperative therewith for preventing the ball from dropping during the throwing stroke, for example, as shown in Japanese Laid-Open Publication No. 56 26427 and in U.S. Pat. No. 4,029,003. But, the addition of the guide rail will certainly result in the loss of energy built up in the throwing arm, thus lowering the speed thereof and therefore, reducing the distance travelled by the thrown ball.

SUMMARY OF THE INVENTION

The present invention has been accomplished with a goal of obviating the above-described shortcoming and has its primary object providing a ball throwing device which is capable of eliminating the energy loss during a throwing cycle yet assuring a controlled pitch.

The ball throwing device of the present invention includes a throwing arm having one end pivotally mounted and defining at the other end a ball receiving portion. The throwing arm is driven to swing within a limited position so as to throw a ball fed to said receiving portion when abruptly moved toward the releasing position. Cooperating with the throwing arm is an annular guide which extends approximately along the path of the ball receiving portion so as to deliver the ball fed at one end thereof to the ball receiving portion of the throwing arm at the cocked position. The annular guide has its one end or the upper end disposed adjacent the feed end or the upper end disposed adjacent the feed end of the stocker accommodating a plurality of balls so as to receive one ball at a time therefrom. The ball thus fed to the upper end of the annular guide is allowed to roll down the guide by gravity to its lower end where it is held on the ball receiving portion of the throwing arm at its cocked position to be ready for throwing action. The guiding surface of the annular guide is configured to be increasingly displaced outwardly from the path of the ball receiving portion in the direction of throwing the ball.

With this arrangement, the ball can be held on the ball receiving portion in loose engagement therewith while being prevented from dropping out therefrom to thereby assure the projection of the ball with less spin. Thus, the energy built up in the throwing arm can be utilized substantially entirely for throwing the ball in a desired trajectory and not consumed for imparting spin to the ball, enabling the throwing arm to be efficiently operated at a minimum power requirement as well as to project a flat ball in a controlled manner for easy batting or tennis stroking practice.

In addition, the ball advancing in the throwing direction by the throwing arm is in frictional engagement with the guide only at the initial stage of the throwing stroke of the arm and is free from frictional engagement at the time of releasing the ball from the arm, such that the guide will not act as a friction surface against the ball just releasing from the arm and therefore will not impart spin to the ball thrown. Also in this respect, it is possible to throw the ball substantially free from spin in a given trajectory and eliminate energy loss built up in the throwing arm.

Accordingly, the ball throwing device of the present invention can throw a ball with less spin or a flat all for easy practicing purposes as well as operating efficiently without causing substantial energy loss during the throwing stroke so as to operate at a minimum power requirement.

In a preferred embodiment, the throwing arm is made of a wire member for attaining light weight construction, which contribute to reduce the energy for driving the arm so that the ball can attain a greater releasing speed with a limited energy source, whereby the ball can be thrown a greater distance while keeping the power requirement at a minimum.

BRIEF DESCRIPTION OF THE DRAWINGS

These and other advantageous features of the present invention will become more apparent from the following description of the preferred embodiment when taken in conjunction with the accompanying drawings; in which.

DETAILED DESCRIPTION OF THE INVENTION

Referring now to FIGS. 1 to 4, a ball throwing device embodying the present invention is a portable and self-contained type which includes a plastic housing 1 and a stocker 2 removably attached thereto for carrying a plurality of balls B such as baseballs and tennis balls.

Figure 3:
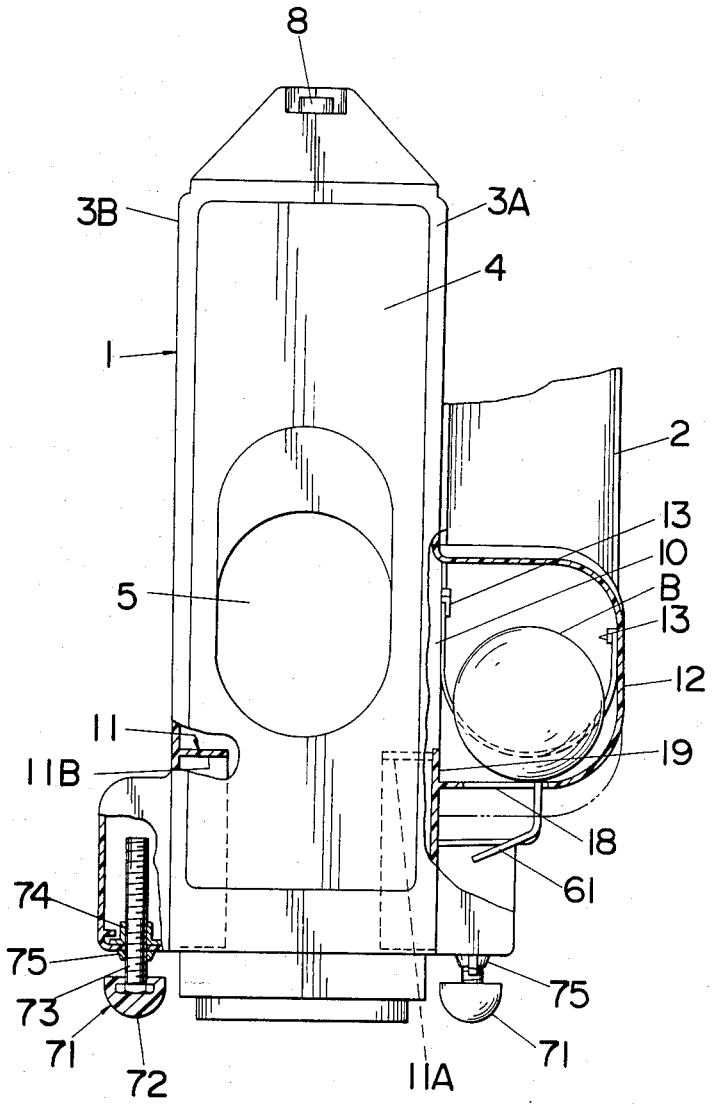
FIG. 3 is a front view partly in section of the above device.

The housing 1 is made of a pair of side halves 3A and 3B and a front panel 4 having a bail discharge portion 5 therein. A handle 6 is formed by the upper portions of the side halves 3A and 3B which are held together by means of screws 7 with a power switch 8 and an external power adapter terminal 9 interposed therebetween. Formed in the side half 3A of the housing 1 adjacent the lower end of the stocker 2 is a ball entrance port 10 through which the balls B are successively fed from the stocker 2 into the upper end of an annular guide 11 formed by a pair of parallel ribs 11A and 11B integrally projecting on the inner surfaces of the respective side halves 3A and 3B. Disposed within the housing 1 is a generally U-shaped frame 20 supporting a ball throwing arm 30, a ball feeding arm 40, and a driving mechanism therefor, the frame 20 being secured to housing 1 by screws 17. Extending integrally on the side half 3A in such a manner as to surround the ball entrance portion 10 is a cap 12 with a rearward opening into which the lower end of said stocker 2 is fitted with its ends engaging complementary lugs 13 on the side half 3A and the cap 12, as best shown in FIG. 3. An extension stocker 14 with a leg 15 is connected to the stocker 2 by means of a joint 16.

Figure 4:
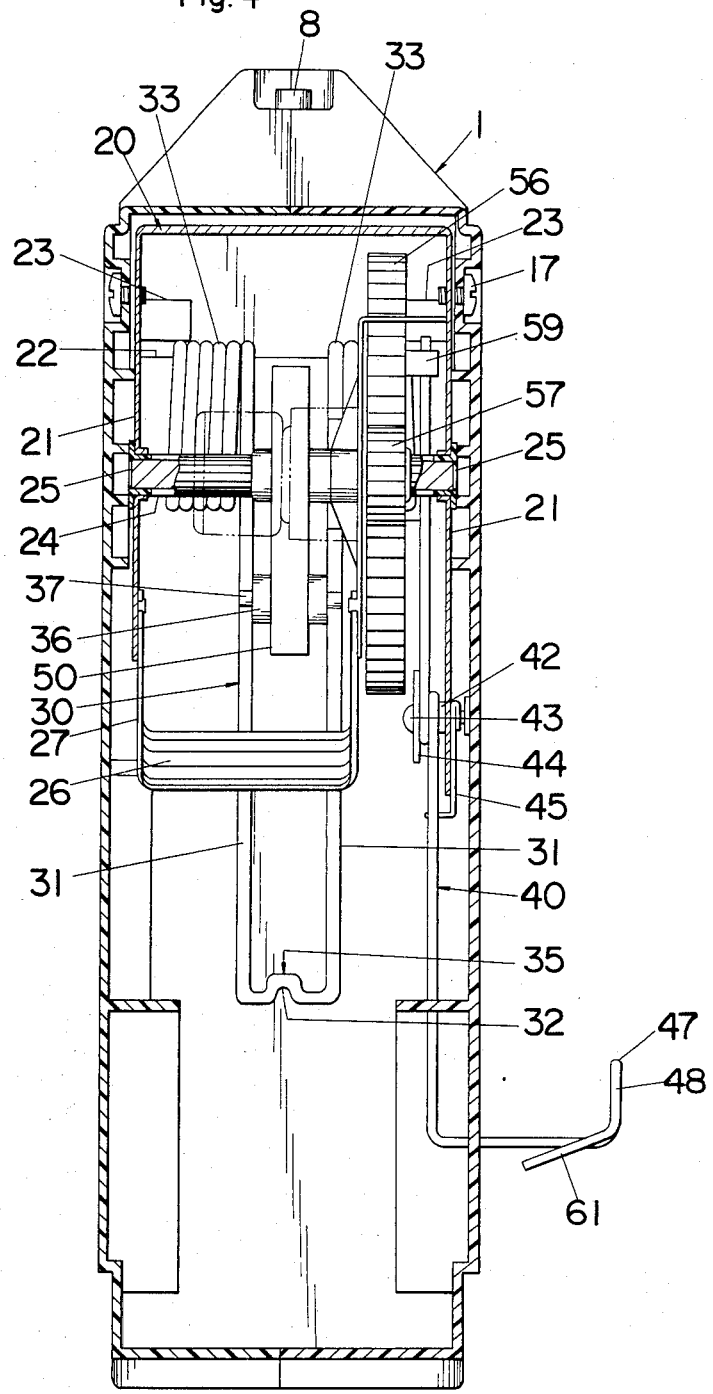
FIG. 4 is a cross section of the above device illustrating the internal mechanism thereof.
Figure 5:
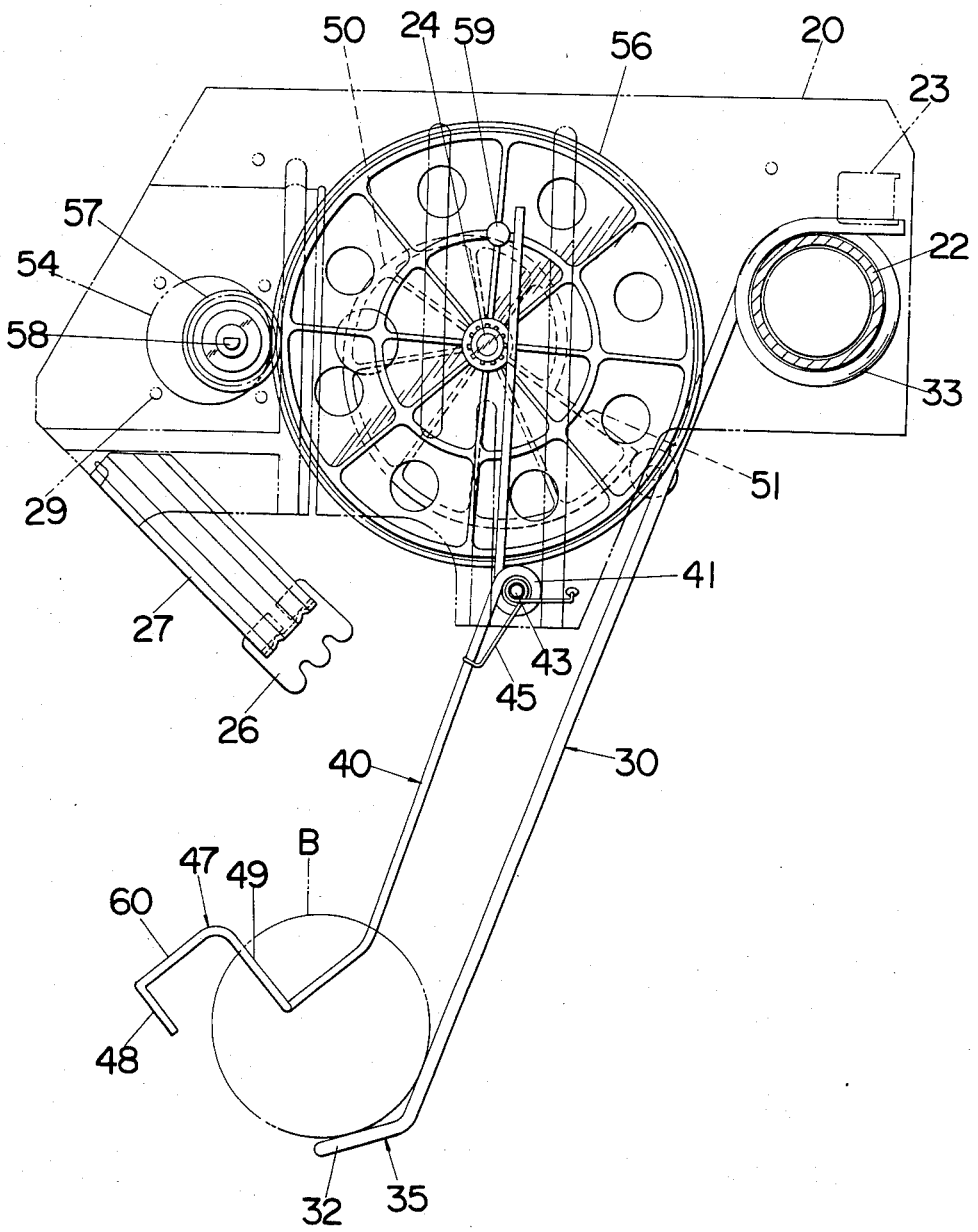
FIG. 5 is a side view of the above mechanism.
Figure 6:
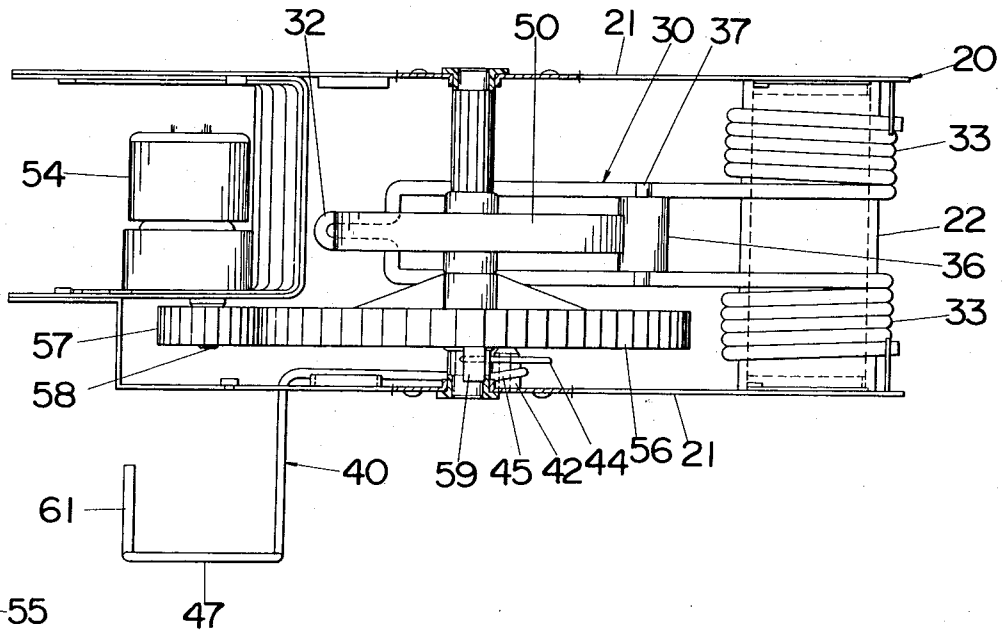
FIG. 6 is a top view of the above mechanism.

As shown in FIGS. 4 to 6, the throwing arm 30 is shaped by a wire member into an elongated U-configuration with a pair of parallel wire segments 31 connected at its lower end by a U-shaped tip 32. The upper end portion of each wire segment 31 is formed into a helical torsion spring 33 which is wound around a pipe shaft 22 extending horizontally in the rear upper portion of the housing 1 and supported between the sidewalls 21 of the frame 20.

Figure 1:
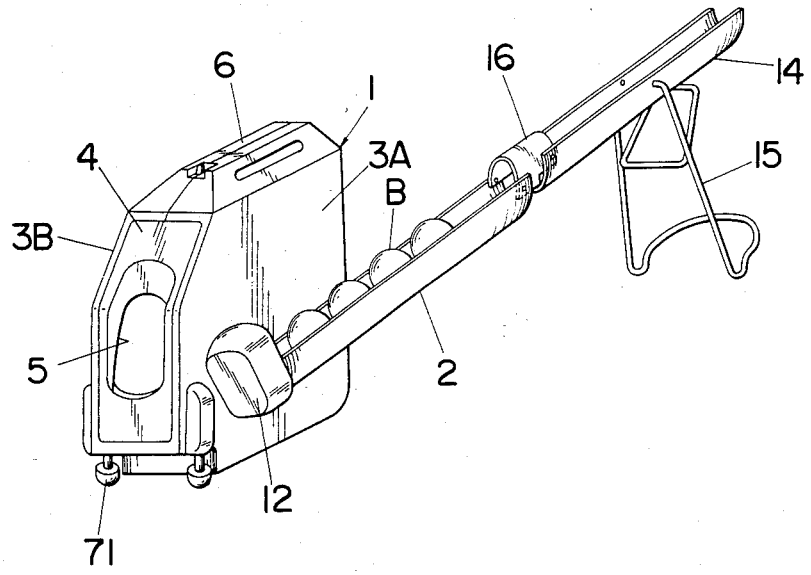
FIG. 1 is a perspective view of a ball throwing device in accordance with a preferred embodiment of the present invention.
Figure 2:
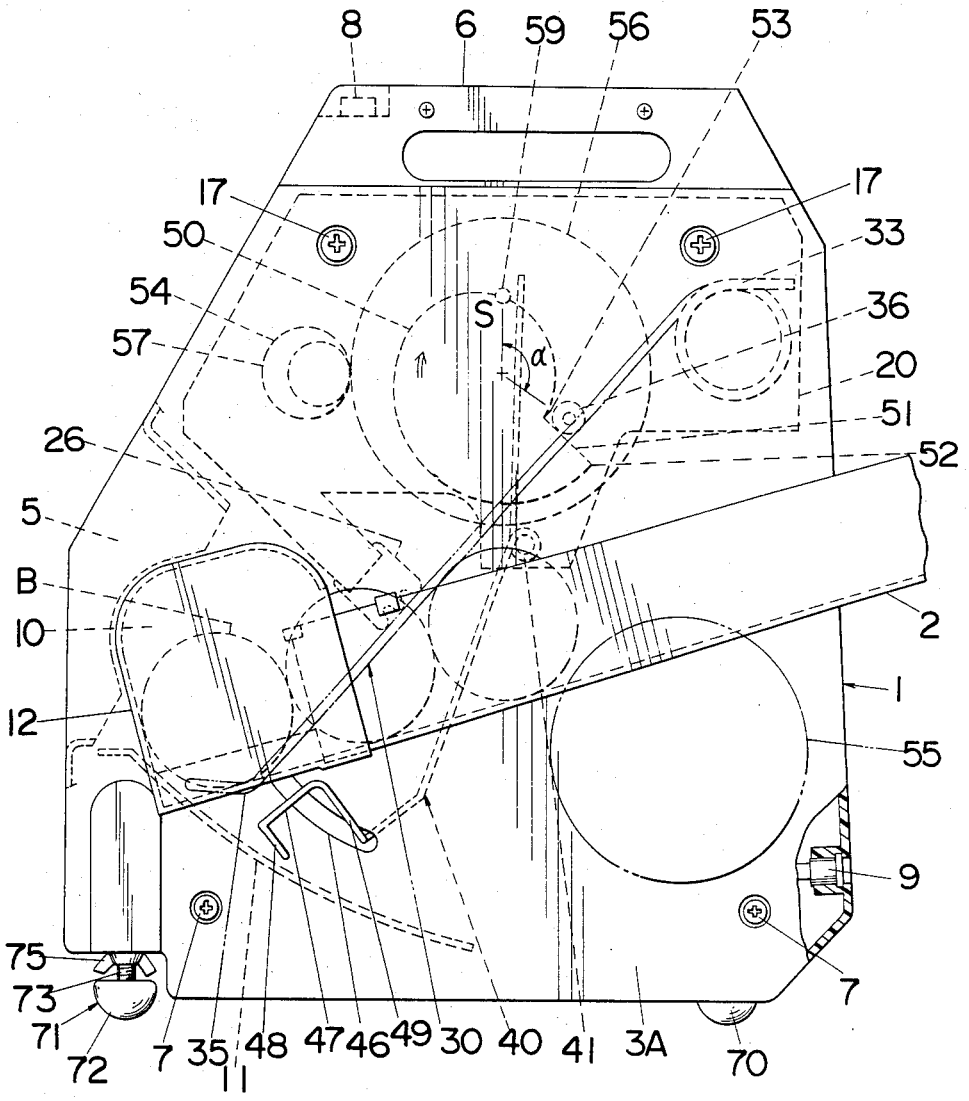
FIG. 2 is a side view of the above device illustrating a throwing arm and its associated mechanism at its position of releasing the ball.

A spring end of each torsion spring 33 is held against a stop 23 fixed on the inside of the frame 20 so that the throwing arm 30 is pivotally supported by the frame 20 to be capable of swinging about an axis of the shaft 22 within a limited angular range while being biased by the torsion springs 33 toward the ball discharge port 5 or in a clockwise direction as viewed in FIGS. 2 and 5. The tip 32 at the lower end of the throwing arm 30 is inclined at an obtuse angle to a throwing direction so as to form thereat a ball receiving portion 35 which receives the ball B in a loose or light-touch engagement therewith so as to release the ball with less spin. The ball B is in contact with the throwing arm 30 at points on the opposed straight wire segments 31 and the center of the tip 32, providing a three-point contact with the ball receiving portion 35 for contributing to the above loose engagement between the ball and the ball receiving portion 35.

Carried on the throwing arm 30 at the portion near the shaft 22 is a cam follower 36 which is rotatably held on a pin member 37 fixedly bridging the opposed wire segments 31. The cam follower 36 is urged into rolling contact with the periphery of a constantly rotating cam 50 so that the the throwing arm 30 is driven by the cam 50 for movement between a cocked position and a release position. The cam 50 is a lifting cam having the contour of gradually increasing radii in the opposite direction of rotation thereof and interrupted by an abrupt transition edge 51, which edge extends from a point 52 of maximum radius to a point 53 of minimum radius, as shown in FIG. 2. The cam 50 is splined on an arbor 24 to be rotatable therewith, the arbor 24 being located forwardly of the shaft 22 in parallel relation therewith with its ends journaled in respective bearings 25 fitted in the sidewalls 21 of the frame 20.

Figure 7:
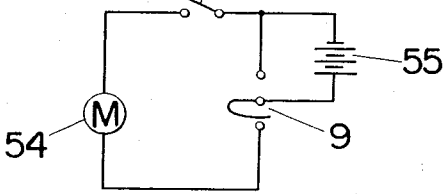
FIG. 7 is a circuit diagram of the above device.

A gearmotor 54 is mounted on the frame 20 by screws 29 for driving the arbor 24 and the cam 50. The motor 54 is energized by an incorporated battery 55, or, alternatively by an A.C. power source by the use of a suitable power adapter (not shown) to be connected to the external power adapter terminal 9, which is connected in parallel with the battery 55 in a driving circuit including the power switch 8, as shown in FIG. 7.

Rotating together with the cam 50 is a gear wheel 56 also splined on the arbor 24 to be in meshing engagement with a small gear 57 secured to an output shaft 58 of the gearmotor 54. That is, the cam 50 is driven to rotate through the transmission line of the small gear 57 and the gear wheel 56.

Figure 8:
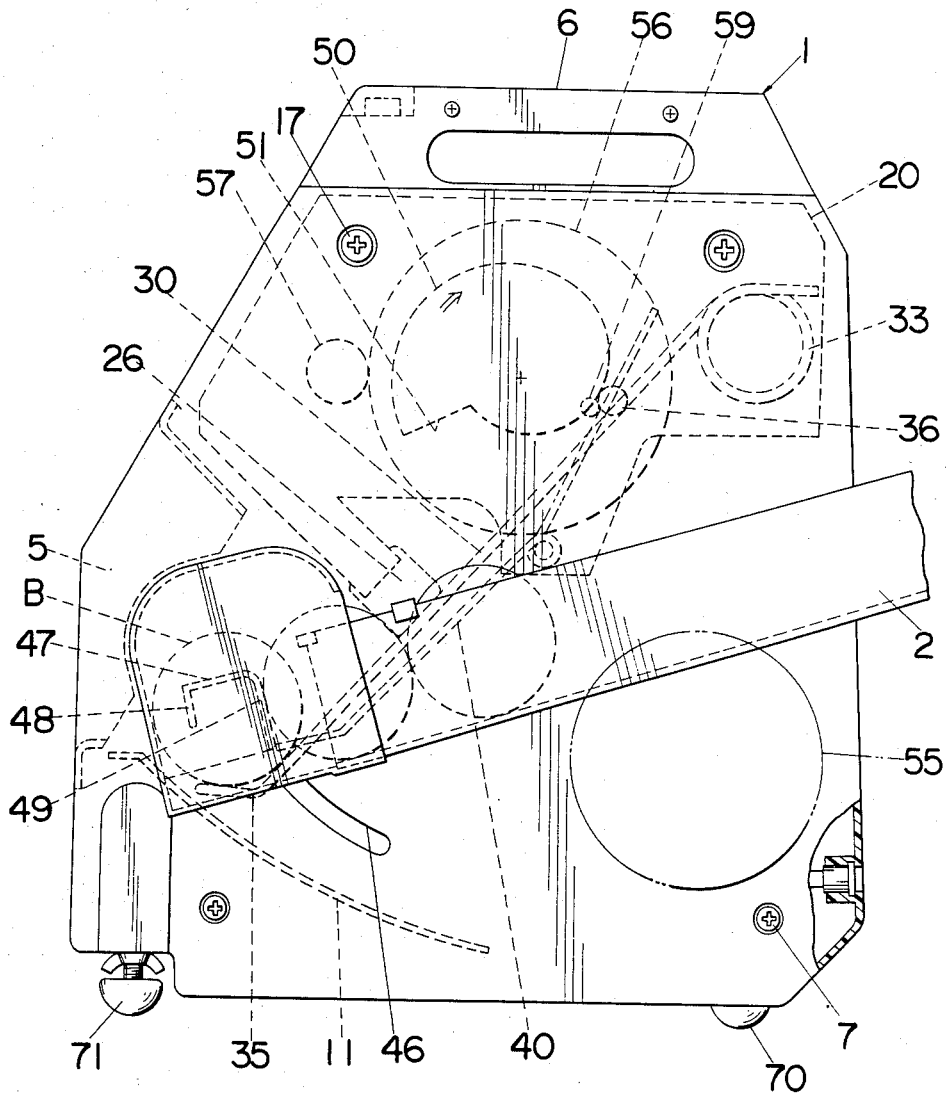
FIG. 8 is a side view similar to FIG. 2 and illustrating the throwing arm at its position after releasing the ball.
Figure 10:
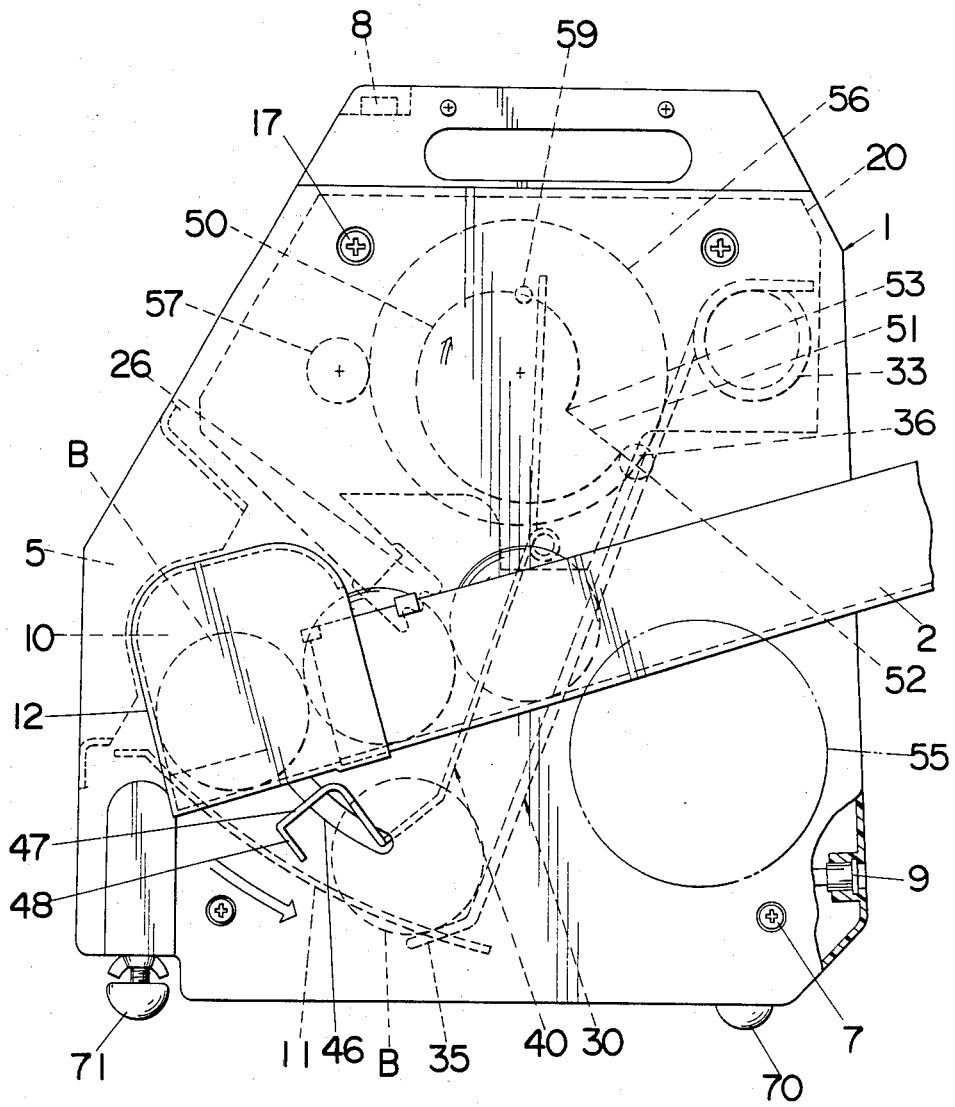
FIG. 10 is a side view similar to FIG. 2 and illustrating the throwing arm at its cocked position.
Figure 11:
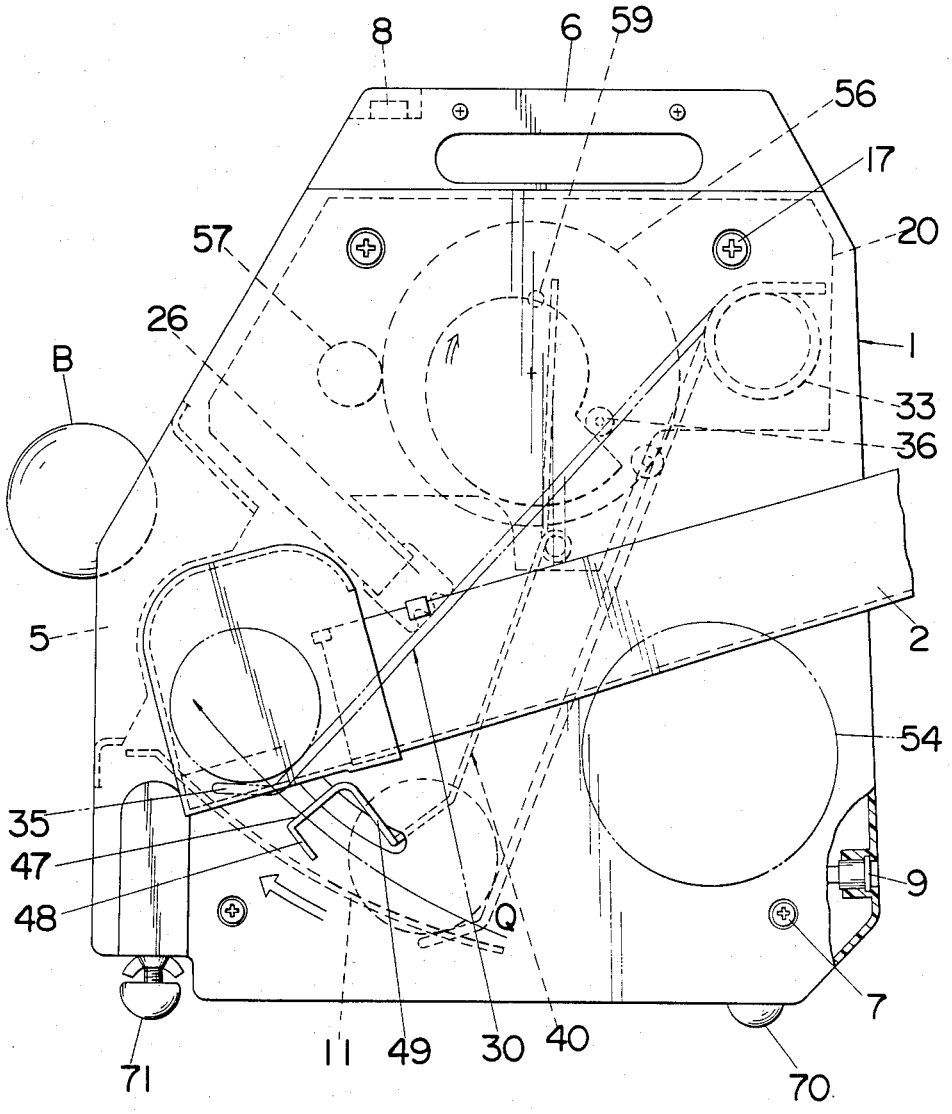
FIG. 11 is a side view similar to FIG. 2 and illustrating the throwing stroke of the throwing arm.

Upon rotation of the cam 50 from the position shown in FIG. 8, the cam follower 36 is initially forced to move radially outwardly until the cam follower 36 reaches the point 52 of maximum radius on the periphery of the cam 50, as shown in FIG. 10, so as to move the throwing arm 30 into the cocked position or lowermost position while loading the torsion springs 33, during which period one ball B fed from the stocker 2 rolls down by gravity on the annular guide 11 as being held by the ball receiving portion 35 of the throwing arm 30 moving to its cocked position. Upon further rotation of the cam 50, as shown in FIG. 11, the cam follower 36 is released from the point 52 of maximum radius so that the throwing arm 30 is urged by the torsion springs 33 to acceleratingly swing forwardy into the releasing position while keeping the three-point contact between the ball B and the ball receiving portion 35. At this releasing position the accelerating throwing arm 30 is suddenly interrupted in its swinging movement by a bumper 26 projecting in the path of the arm 30 so as to allow only the ball B to be projected forwardly through the ball discharge port 5 in the housing 1. The bumper 26 is made of rubber or like elastic material and supported by the frame 20 through a stay 27. In this connection, the ball discharging port 5 is dimensioned to be large enough so that the ball B under acceleration within the housing 1 can be readily perceived by the user.

After throwing the ball B, the throwing arm 30 remains in the releasing position for a short time period, during which period the cam 50 continues to rotate from the position shown in FIG. 2 to the position shown in FIG. 8, and then moves back to the cocked position by the continued rotation of the cam 50 to be ready for the next throwing operation. In this manner, the throwing arm 30 repeats the ball throwing cycles as the cam 50 rotates for successively throwing the balls at a regular interval.

A ball loading mechanism is operated in synchronism with the throwing arm 30 for feeding one ball B at a time from the stocker 2 onto the annular guide 11 during each throwing cycle of the throwing arm 30.

The mechanism includes the ball feeding arm 40 which, as shown in FIGS. 2, 4, and 5, is pivotally supported on the frame 20 at the portion intermediate its length. The feeding arm 40 is made of a wire member having the portion intermediate its length turned to form thereat an eye 41 into which a sleeve 42 secured to the sidewall 21 of the frame 20 by a screw 43 and a collar 44 extends so that the feeding arm 40 can pivot about the axis of the sleeve 42. A biasing spring 45 is wound about this axis with one of the spring ends fastened to the frame 20 and the other spring end to the feeding arm 40 for biasing it backwardly or in a counter clockwise direction as viewed in FIGS. 2 and 5.

The upper end portion of the feeding arm 40 extends in parallel relation with the gear wheel 56 so as to be in engagement with a stud 59 which projects on the side face of the gear wheel 56 to be movable together with the gear wheel 56 and the cam 50 in a circular path about the common axis. The stud 59 is in engagement with the upper end portion of the feeding arm 40 during a limited angular range of rotation to swing the feeding arm 40 in one direction against the biasing force of the spring 45 and is out of engagement therewith during the rest of the rotation to swing the feeding arm 40 back in the opposite direction by the restoring action of the spring 45.

The lower end of the feeding arm 40 is bent at a right angle to extend in a lateral direction outwardly through an arcuate aperture 46 in the side half 3A of the housing 1 and further bent to form an inverted U-shaped ball feeding member 47 which is spaced from the sidewall of the housing 1 in parallel relation therewith and includes front and rear fingers 48 and 49 connected by a web 60. The front finger 48 has its lower portion angled to form thereat an oblique segment 61 which extends downwardly toward the housing 1.

Figure 9:
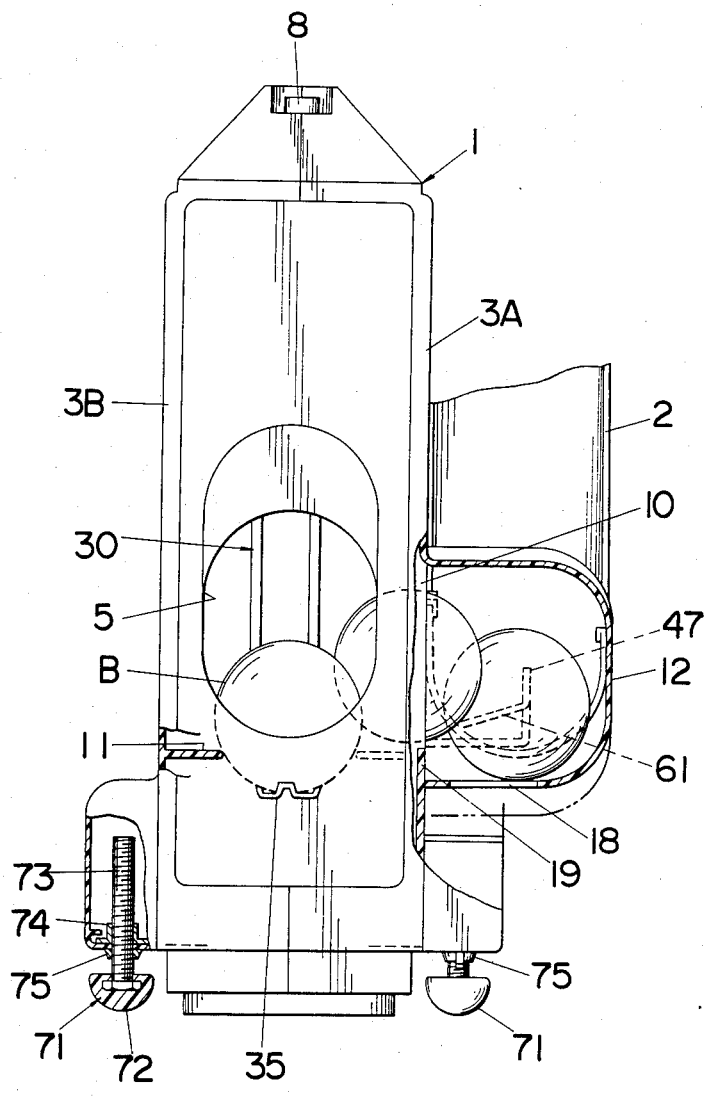
FIG. 9 is a front view similar to FIG. 3 and illustrating a manner of feeding the ball from a stocker onto a guide inside of the device.

When the feeding arm 40 swings into the forwardmost position, as shown in FIGS. 8 and 9, the U-shaped member 47 advances into the cap 12 through a bottom opening 18 thereof to thereby lift one ball B in such a way as to feed the ball B down along the oblique segment 61 onto the annular guide 11 beyond an upright stop wall 19 formed along the lower periphery of the ball entrance port 10. At this occurrence, the rear finger 49 of the U-shaped member 47 projects in the ball feeding way to block the gravity feed of the remaining balls in the stocker 2. After releasing the ball B onto the annular guide 11, the U-shaped member 47 swings back to the lowermost position, as shown in FIG. 10, to thereby allow the next ball to advance by gravity into the cap 12 for next charging of the ball.

The angular disposition of the stud 59 is such that the stud 59 actuates the feeding arm 40 to swing in the forward direction for completion of the ball charging onto the annular guide 11 during a dwell period while the throwing arm 30 is still in its releasing position or upwardmost position after projection of the ball, completing the ball charging operation during each throwing cycle. That is, as shown in FIG. 2, the throwing arm 30 is blocked by the bumper 26 from further being urged in the forward direction such that the cam follower 36 of the throwing arm 30 is out of engagement with the periphery of the cam 50 within a particular angular range $\alpha$ of the cam 50 from an instant when the cam follower 36 reaches the point 53 of minimum radius to an instant when it reaches a specific point S along the periphery of the cam 50.

Consequently, the ball B fed onto the upper end of the annular guide 11 is held by the ball receiving portion 35 of the throwing arm 30 remaining in the releasing position and then rolls down on the guide 11 slowly while being backed by the ball receiving portion 35 as the throwing arm 30 swings subsequently back to its cocked position. Thereafter, the throwing arm 30 is loaded followed by being acceleratingly swung to the releasing position for throwing the ball in the manner previously described.

It should be noted at this time that the stud 59 does not yet come into urging contact with the ball feeding arm 40 when the cam follower 36 reaches the point 52 of maximum radius on the periphery of the cam 50, as shown in FIG. 10, and comes into contact therewith only after the cam follower 36 is released from that point to cause the throwing arm 30 to project the ball B, whereby the torque required for movement of the ball feeding arm 40 is not added to the driving mechanism at the time of loading the throwing arm 30 to a maximum extent or to its cocked position. Accordingly, the power requirement for driving the feeding arm 40 can be within that for driving the throwing arm 30 so that the present device can be operated at a minimum power requirement enough for driving the throwing arm 30.

The annular guide 11 is for guiding the ball B onto the ball receiving portion 35 of the throwing arm 30 as the cocked position and prevents balls from accidentally dropping out of the ball receiving portion 35 before it is thrown. With this result, the ball receiving portion 35 can be designed to provide such a loose engagement with the ball so as to throw a flat ball or a ball with less spin for each batting or tennis stroke practice. Thus, the energy built up in the throwing arm can be effectively consumed for projecting the ball in a desired trajectory rather than imparting spin.

For the above purpose, the annular guide 11 extends from its lower end to the upper end adjacent the ball discharging port 5 in an annular path which is generally along the path of the ball receiving portion 35 indicated by chain-dot line Q in FIG. 11, but it is increasingly displaced radially outwardly therefrom as it extends in the throwing direction such that the ball is in frictional engagement with the annular guide 11 only at the initial stage in the ball throwing stroke.

In the subsequent ball throwing stroke, the ball can be stably held by the ball receiving portion 35 under acceleration and is kept free from frictional engagement with the annular guide 11, eliminating loss of energy due to that friction in the course of projecting the ball for efficient utilization of the energy built up in the throwing arm 30 entirely for projecting the ball. Further, the ball at the very instant of being projected from the ball receiving portion 35 will not touch the annular guide 11 so as to exclude the possibility of imparting spin to the ball also in this respect.

The housing 1 on its rear bottom is provided with a rear fixed rubber foot 70 and on its front bottom with a pair of adjusting feet 71 which provide a means for adjusting the angle of the ball trajectory. Each of the adjusting feet 71 includes a ground contact rubber pad 72 and a threaded shank 73 extending vertically through the bottom wall of the housing 1 to be matingly engaged with a fixed nut 74 inside of the housing 1 and a wing nut 75 outside of the housing 1. Adjustment of the angle of the ball trajectory is made by loosening the wing nuts 75 followed by turning the threaded shanks 73 to a desired amount.

We claim:

1. A ball throwing device which comprises:

a throwing arm having one end pivotally mounted and defining at the other end a ball receiving portion, said arm being driven to swing within a limited angular range between a cocked position and a releasing position so as to throw a ball fed to said receiving portion when moved toward the releasing position, said throwing arm comprising a pair of parallel wire segments connected at its ends, which end portion being angled in the direction of throwing the ball so as to define thereat said ball receiving portion;

an annular guide extending approximately along the path of said ball receiving portion so as to guide the ball fed at one end thereof onto said ball receiving portion of the throwing arm at the cocked position; and a guiding surface of the annular guide on which the ball guided is increasingly displaced outwardly from the path of the ball receiving portion in a direction of throwing the ball.

2. A ball throwing device as set forth in claim 1, wherein said annular guide is made of a pair of rails spaced in parallel relation.

* * * * *